US006139683A

United States Patent [19]

Nimz et al.

[11] Patent Number: 6,139,683

[45] Date of Patent: Oct. 31, 2000

[54] WOOD PULPING WITH ACETIC ACID WITH THE ADDITION OF FORMIC ACID

[75] Inventors: Horst Harry Hermann Nimz; Martin Schöne, both of Hamburg, Germany

[73] Assignee: Gebruder Kammerer Projekt Agentur GmbH, Germany

[21] Appl. No.: 08/540,571

[22] Filed: Oct. 6, 1995

Related U.S. Application Data

[63] Continuation of application No. 08/110,867, Aug. 24, 1993, abandoned.

[30] Foreign Application Priority Data

Aug. 25, 1992 [DE] Germany ..... 42 28 171

[51] Int. Cl.[7] ..... D21C 3/04; D21C 3/20

[52] U.S. Cl. ..... 162/19; 162/76

[58] Field of Search ..... 62/76, 17, 19, 62/241, 60, 56

[56] References Cited

U.S. PATENT DOCUMENTS 2,645,633 7/1953 Richmond et al. ..... 162/76

3,553,076 1/1971 Haas et al. ..... 162/76

4,904,342 2/1990 Arnoldy et al. ..... 162/76

FOREIGN PATENT DOCUMENTS 0 485 150 5/1992 European Pat. Off. ..... 162/76

82/01902 6/1982 WIPO .

OTHER PUBLICATIONS

Plooy, "Non–Chlorine bleaching of chemical pulp–A development study", Natl. Timber Inst. Apr. 1984.

*Primary Examiner*—Steven Alvo

*Attorney, Agent, or Firm*—Cook, Alex, McFarron, Manzo, Cummings & Mehler, Ltd.

[57] ABSTRACT

In a process for the extraction of celluloses from lignocelluloses, the extraction is carried out by means of heating with aqueous acetic acid under pressure and the addition of formic acid, whereby there is obtained a cellulose with a very low residual lignin content, which can be bleached with ozone and peracetic acid to high grades of white, and acetic and formic acid are recovered by means of distillation, so that waste waters do not, therefore, accumulate.

13 Claims, 1 Drawing Sheet

WOOD PULPING WITH ACETIC ACID WITH THE ADDITION OF FORMIC ACID

RELATED APPLICATIONS

This application is a continuation of application Ser. No. 08/110,867, filed Aug. 24, 1993, now abandoned.

BACKGROUND OF THE INVENTION

The invention relates to a process for the extraction of cellulose, and bleached cellulose and chemical cellulose, which can be obtained in accordance with this process.

Conventional processes for the extraction of cellulose, such as the sulfite and sulfate processes, lead to discharges which contain sulphur, in the combustion of which waste gases which contain $SO_2$ arise. The high residual lignin contents of the celluloses, of 4% to 5% by weight, require large quantities of bleaching chemicals, which lead to chlorinated organic compounds in the waste waters. It is disadvantageous in this process, furthermore, that, because of the re-extraction of the chemicals through the combustion of the discharges, plants with a minimum capacity of 1,000 thousand tons per day of cellulose are necessary, There is described, in U.S. Pat. No. 3,553,076, a wood pulp with aqueous acetic acid under pressure at 150° C. to 205° C., in which celluloses with residual lignin contents of 2% to 3% by weight (corresponding to cap figures of 12 to 20) are obtained. According to DE-A-34 35 132, the wood can be pulped even at normal pressure, if catalytic quantities of hydrochloric acid are added to the acetic acid (the acetosolve process). The residual lignin contents of the cellulose do not, in any event, decline, and chloride ions perform, in the presence of acetic acid, in a strongly corrosive manner.

Other mineral acids, such as sulphuric acid, phosphoric acid, perchloric acid, $MgCl_2$, or nitric acid have been investigated as catalysts for use during wood pulping with acetic acid, but have, however, yielded celluloses, without exception, which have higher residual lignin contents and lead to problems in the recovery of the mineral acids.

Formic acid has also been proposed as a means for wood pulping. Thus, in a two-state process, chopped scraps are treated in the first stage with formic or acetic acid and, in the second stage, hydrogen peroxide is added and heated up to 70° C. to 100° C. The quantities of hydrogen peroxide which are necessary for this, however, are too high in relation to an economic process management (Poppius et al., Paper and Timer, 73 (2), pages 154–158 [1991]).

It is an object of the present invention to provide a process for the extraction of cellulose, by means of which celluloses with distinctly lower residual lignin are obtained.

This object is solved by means of a process in which lignocelluloses with aqueous acetic acid are heated under pressure and the addition of formic acid.

Wood or annual plants can be used as the initial celluloses. The pulping temperature preferably lies between 130° C. and 190° C. The concentration of the acetic acid in the pulping medium is, preferably, between 50% and 95% by weight; that of the formic acid below 40% by weight; and that of the water below 50% by weight. The weight ratio of the lignocellulose to the pulping solution preferably amounts to 1:1 to 1:12.

In accordance with another form or implementation, the process can also be used for the extraction of lignin and hemicelluloses from lignocelluloses. The process management can take place either continuously and discontinuously whereby, in the event of a continuous process management, the crushed lignocellulose is fed into a pressure cooker, in which it is extracted from the pulping solution in the counter-current, and continuously leaves the cooker at the other side in extracted form. By this means, for example, 2 to 20 pulping vessels can be connected in series, one after the other.

In accordance with additional preferred forms of implementation, the shredding of the cellulose and the washing process of the cellulose is included in the process in accordance with the invention. The lignocelluloses can, in order to remove the contents, be pre-extracted with a solvent, and acetic anhydride and bleaching agent can be added to the pulp solution. In accordance with one additional preferred form of implementation, the lignocelluloses are impregnated, before being fed into the pulping vessel, with formic acid, acetic acid, acetic acid anhydride, or the vapors of the same. The impregnation can also be carried out with a solvent or the vapors of the same, which forms an azeotrope with water.

The lignins and hemicelluloses with high degrees of purity which are likewise accumulating can be used, for example, for the production of glue.

The process in accordance with the invention has the advantage, relative to the conventional process for the extraction of cellulose, that it does not use any inorganic pulping chemicals, so that no exhaust gases which contain $SO_2$, or waste waters which contain heavy metals, are thereby brought about. Formic and acetic acids are recovered by means of distillation, so that the lignins and the hemicelluloses do not need to be subjected to combustion in order to recover the chemicals. One additional advantage consists of the fact that the pulping temperature is approximately 10° C. lower than it is in the conventional process, as the result of which the costs for energy are considerably reduced.

BRIEF DESCRIPTION OF THE DRAWING

There is shown in the drawing, FIG. 1, a graph comparing the rigidities of Formacell and sulfate pinic cellulose in dependence on the degree of grinding.

DETAILED DESCRIPTION OF THE INVENTION

Figure 1:
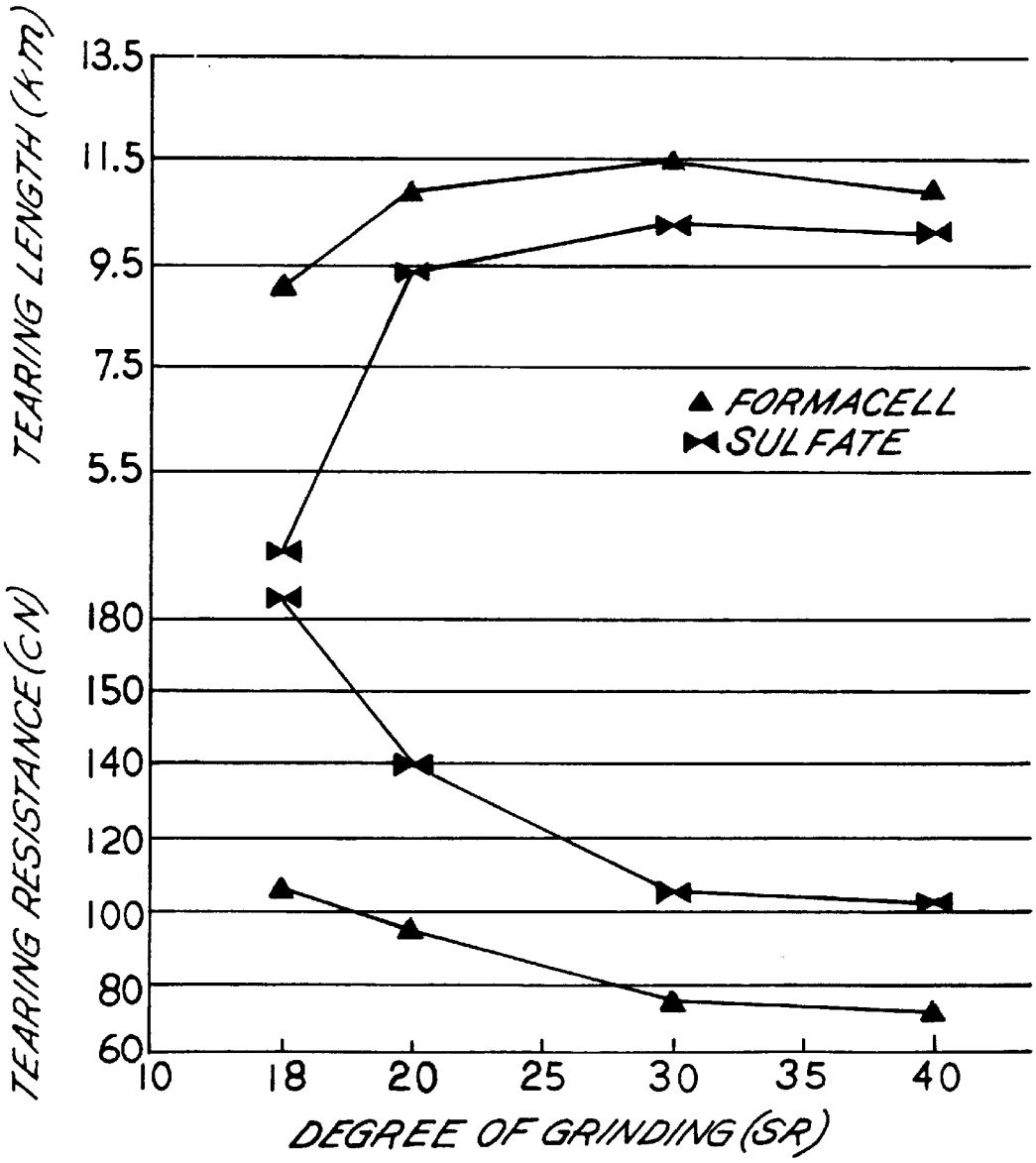

The cellulose which is obtained in accordance with the invention has a distinctly lower residual lignin content, and improved characteristics. It can be seen from Table 1 that the addition of 10% by weight of formic acid under otherwise equal pulping conditions brings about, with the use of pinic cellulose, a reduction of the kappa figure from 15.6 to 3.6, which corresponds to a lignin content of 2.5 to 0.5, while the yield only drops off slightly.

Something similar applied in the case of poplar and Miscanthus cellulose (Table 1). The levels of whiteness of the three celluloses was correspondingly increased by 8% to 15%. The lower kappa figures and the higher levels of whiteness mean a lower application of the expensive bleaching chemicals, which are of significance for the economical nature of the process.

The cellulose characteristics after pulping (2 hours, 180° C., poplar and Miscanthus 170° C.), with 85% acetic acid, 85% acetic acid and 10% formic acid, are compared in Table 1. As can be seen from this table, the solidity characteristics of the celluloses which are obtained with the formic acid supplement are distinctly increased. This applies in particular for the tearing resistance, which is generally lower, in acidic pulping processes, than it is in alkaline ones, such as, for example, the sulfate process. Since sulfate celluloses are generally considered at the present time to be standard for paper production, the increase in the tearing resistance in the process in accordance with the invention is accorded great importance.

TABLE 1

| | Acetic acid 85% | | | Acetic acid 85% + Formic acid 10% | | |
|---|---|---|---|---|---|---|
| | Spruce | Poplar | Misc. | Spruce | Poplar | Misc. |
| Kappa number: | 15.6 | 9.2 | 13.3 | 3.6 | 3.1 | 3.2 |
| Yield (%): | 48.0 | 50.1 | 48.6 | 46.8 | 50.3 | 48.2 |
| Degree of whiteness (% ISO): | 20.3 | 20.0 | 25.9 | 28.0 | 34.7 | 33.8 |
| GVZ (MI/g): | 1050.0 | 1005.0 | 1022.0 | 1179.0 | 849.5 | 1012.0 |
| DPW: | 3035.0 | 2850.0 | 2910.0 | 3490.0 | 2430.0 | 2870.0 |
| Tearing resistance (*) (cN): | 59.1 | 31.1 | 51.5 | 77.1 | 42.7 | 90.4 |
| Busting surface (*) ($m^2$): | 62.9 | 31.4 | 24.6 | 70.9 | 38.0 | 43.9 |
| White length (*) (in km): | 10.3 | 7.5 | 5.2 | 11.4 | 7.3 | 8.1 |
| R-10 (%): | 90.1 | 5.9 | 88.5 | 93.6 | 89.4 | 91.0 |
| Mannose (%): | — | 2.3 | — | 0.5 | 1.2 | 0.2 |
| Xylose (%): | — | 5.4 | — | 1.5 | 2.4 | 3.3 |
| Glucose (%): | — | 92.3 | — | 94.2 | 93.5 | 96.2 |

(*) Paper strengths at degree of fineness 30° SR.

In this table, "GVZ" means the boundary viscosity figure in accordance with Staudinger; "DPW" means the polymerization level; while "R-10" means the residual cellulose, which is insoluble in 10% NaOH.

The increase in the R-10 values, which is likewise evident from Table 1, means, in connection with the lower xylose and mannose contents, lower hemicellulose contents in the celluloses which are obtained with the addition of formic acid, and thus their suitability as starting materials (chemical celluloses) for the production of cellulose derivatives. The process in accordance with the invention offers advantages, in particular, relative to the production of cellulose acetate because, in this case, the preliminary swelling of the cellulose in the acetic acid before the acetylization, as well as an acetic acid recovery stage, are both dispensed with.

The optimal concentration of formic acid depends on the pulping temperature, the pulping time, the type of wood, and the water content of the pulping medium. As is evident from Table 2, the lignin condensation predominates at 190° C., with 20% formic acid, as early as after 1 hour, for which reason a two-hour pulping with 10% formic acid, at 180° C. or 170° C., was selected in Table 1. The acetic acid concentration in Table 2 amounts to 85%.

The formic acid increases the acidity of the pulping medium and thereby the breakdown of the lignin, while the lignin condensations increase more slowly. The selectivity of the formic acid in the breakdown of the lignin appears to be increased relative to the use of mineral acids as catalysts. Moreover, the formic acid increases the solubility of the lignin in the pulping medium.

The chlorine-free bleaches of the celluloses obtained in accordance with the process in accordance with the invention are fundamentally simplified relative to that of conventional celluloses. Whereas in the conventional cellulose bleaches, five bleaching stages are normally used at the present time, in which oxygen, peroxide, ozone, caustic soda and, if necessary, chlorine dioxide, are required, only two to three bleaching stages with slight quantities of ozone in acetic acid and/or peracetic acid are enough for the bleaches of the process in accordance with the invention.

In the following examples, the percentage figures refer to the weight.

EXAMPLE 1

Chopped spruce wood scraps (20×35×5–6 mm), with a moisture content of 8%, had a 5-fold weight quantity of 85% acetic acid, which contained 10% formic acid, poured over them, and were heated in a rotary autoclave for 2 hours at 180° C. (heating time of 40 minutes). After that, through the evaporation of a portion of the cooking lye, it was cooled off to below 100° C., the fiber material was pressed off onto suction filter, and it was then subsequently washed with 85% acetic acid. The filter cake was, by means of a laboratory mixer, impacted under 85% acetic acid in a large beaker, and was then suction filtered again. The cellulose obtained was free of splinters, and had the characteristics which are stated in Table 1.

For the purpose of the comparison, chopped spruce scraps with 85% acetic acid, which contained no formic acid, were pulped and processed under conditions which were otherwise the same. The characteristics of the cellulose which was obtained under these conditions are likewise depicted in Table 1.

The spruce cellulose obtained through the addition of formic acid (Table 1) was washed, on a suction filter, with acetic acid, pressed out to a consistency of 35%, aerated in a coffee grinder for 30 seconds, then in a round bottom flask on the rotation evaporator with a 3% ozone/oxygen mixture. After that, the cellulose was, on a suction filter, first washed with water and, after that, washed with a 0.2% peracetic acid solution in water, and pressed out to a 15% consistency, heated for 1 hour at 80° C., and then finally washed on the suction filter with water. The bleached spruce cellulose has the characteristics stated in Table 3.

TABLE 2

Key to chart below:

A = Temperature ° C. B = Formic acid (%) C = Kappa figure
D = Degree of whiteness (% ISC) E = Yield (%)

| A | 190 | | | | 180 | | | | 170 | | | |
|---|---|---|---|---|---|---|---|---|---|---|---|---|
| B | 5.0 | 10.0 | 15.0 | 20.0 | 5.0 | 10.0 | 15.0 | 20.0 | 5.0 | 10.0 | 15.0 | 20.0 |
| C | 7.2 | 5.3 | 5.6 | 14.6 | 14.5 | 11.2 | 7.8 | 7.1 | 39.9 | 25.4 | 14.5 | 7.1 |
| D | 27.9 | 29.9 | 28.7 | 24.4 | 22.6 | 25.8 | 26.3 | 27.0 | 18.8 | 22.6 | 24.6 | 27.6 |
| E | 46.3 | 43.6 | 42.2 | 42.2 | 49.2 | 48.0 | 46.6 | 45.3 | 54.8 | 50.3 | 47.0 | 46.6 |

In a second batch, the spruce cellulose, at 15% consistency, was bleached with peracetic acid only, first in acetic acid, with 0.7% at 80° C., for 90 minutes, and then in water with 1.3%, at 80° C., for 120 minutes. The results are also presented in Table 3.

EXAMPLE 2

Chopped scraps (80×20×5 mm) of a six-year old poplar (Populus nigra from the clone "Rapp"), with a moisture content of 10%, had a six-fold quantity of an 85% acetic acid, which contained 10% formic acid, poured over them, and were then heated to 170° C., for two hours, in the rotary autoclave. The processing, shredding and washing of the cellulose were carried out as described in Example 1 for the spruce cellulose. The characteristics of the cellulose are reproduced in Table 1.

The bleaching of the cellulose was carried out in two stages with peracetic acid, first with 0.7% in 6.6 parts of acetic acid, for 90 minutes at 80° C., and then with 1.3% of peracetic acid in 6.6 parts of water for 120 minutes at 80° C. The characteristics of the bleached cellulose are reproduced in Table 3.

EXAMPLE 3

Stems of Miscanthus sinensis "Giganteus", chopped to a length of 2.5 cm, with a moisture content of 18%, were poured with the ten-fold quantity of 85% of acetic acid, which contained 10% formic acid, and heated, in a rotary autoclave, for 2 hours, to 170° C. (heating time: 40 minutes). The processing, shredding and washing of the cellulose were carried out as described in Example 1 for spruce cellulose. The cellulose was free of splinters, Its characteristics are evident from Table 1, and are contrasted with those for cellulose which was obtained under the same conditions, but with the exclusion of the acetic acid.

The bleaching of the cellulose was carried out in two states with peracetic acid, as described under Example 2 for poplar cellulose. The characteristics of the bleached cellulose are presented in Table 3.

EXAMPLE 4

Chopped spruce scraps of the type as stated under Example 1 had a six-fold quantity of 85% acetic acid poured over them, which contained, in four batches, 5, 10, 15 or 20% formic acid, and were heated in the rotary autoclave to 180° C. for 1 hour each. The processing, shredding and washing of the cellulose which was obtained was carried out in the same manner as in Example 1. After that, the celluloses were free of splinters. Their contents of residual lignin, levels of whiteness, and yields can be seen in Table 2.

TABLE 3

Characteristics of the Cellulose With Degree of Fineness 20-SR Bleached with Ozone (Z) and Peracetic Acid (Pa).

Key to chart below:

A = Cellulose
B = Bleaching agent
C = Quantity (%)
D = Degree of whiteness (% ISO)
E = Breaking length (km)
F = Bursting surface ($m^2$)
G = Tearing strength (cN)

| (A) | (B) | (C) | (D) | (E) | (F) | (G) |
|---|---|---|---|---|---|---|
| Spruce | Z/Pa | 0.6/1.3 | 64.3 | 9.315 | 52.5 | 76.7 |
| | Pa/Pa | 0.7/1.3 | 72.1 | 9.113 | 50.3 | 79.1 |
| Poplar | Pa/Pa | 0.7/1.3 | 83.4 | 6.68 | 28.8 | 46.0 |
| Miscanthus | Pa/Pa | 0.7/l.3 | 83.0 | 6.933 | 35.6 | 89.6 |

One preferred form of implementation of the process in accordance with the invention (the 'Formacell' process) will be described in the following. The percentage figures relate to the weight.

| A. Pulping | |
|---|---|
| Cooker | 2.5 × 10 m = 49 $m^3$; |
| Pulping solution: | Acetic acid/water/formic acid (75:15:10); |
| Temperature: | 106° C. to 180° C.; |
| Time: | 1 to 2 hours; |
| Batch ratio: | 1:5. |

One cooker (batch process, 25 tons of cellulose/d) is sufficient for the experimental phase while, for the production, 6 to 12 cookers are connected in series one after the other (semi-continuous process, maximum of 300 tons of cellulose/d). It is only through the connection of several cookers in series that an extraction of the chopped scraps, in accordance with the counter-current principle, with the optimal utilization of the pumping solution, is possible. The heating of the chopped scraps is carried out by means of the pump circulation of the pulping solution, which is heated externally in the heat exchangers.

B. Bleaches With Hydrogen Peroxide

The first bleaching state is carried out with 1% to 2% hydrogen peroxide in the cooker after the completion of the pulping and the expulsion of the extract through fresh pulping solution, for 1 to 2 hours, at 70° C. to 90° C. A uniform distribution of the $H_2O_2$ is carried out through the pump circulation of the bleach solution, the composition of which does not differ, up to the $H_2O_2$, from the pulping solution. The active agent is peracetic acid, the formation of which is catalyzed by means of the formic acid which is present.

C. Sorting

The sorting consists of a post-defibering (separation), a rough sorting, and purification. For the first two steps, there is proposed an aperture sorting device which is equipped with stirring arms (slot width of approximately 0.4 mm) in the manner of a tube centrifuge, while a hydrocyclone device is proposed for the purification. The diffusing device (concentrating device) must be very effective, in order to proceed, from a substance density of approximately 1% which is necessary for the sorting, to at least 8%, from which, in a screw pump, a consistency of approximately 50% must be attained for the ozone bleach.

The cellulose wash takes place simultaneously in the sorting. A separate washing, such as in the conventional process, is not necessary, because no inorganic pulping chemicals are to be washed out, and the cellulose which is leaving the cooker scarcely contains lignin any longer. The flushing out of the foreign materials and contaminants, the conveying of the flushing solution, as well as the guiding of the fiber suspension during the sorting process, can be seen in the flow chart. The effectiveness of the sorting can be improved by means of several tube centrifuges or cyclone units which are connected in series one after the other.

D. Ozone Bleaching

The ozone bleaching is carried out in a rotating drum at 20° C. to 50° C., and a substance density of approximately 40%, whereby the residence time of the cellulose should amount to at least 10 min., ozone quantity approximately 0.5%, computed in relation to the cellulose. Because of the good solubility of the ozone in the acetic acid, a filling up of the cellulose is not necessary.

Because of the danger of the explosion of acetic acid vapors in the case of oxygen/ozone mixtures, an implementation of the rotating drum in a manner which is protected from explosions is necessary. The exhaust gases should be kept within the circuit, or within a closed system. Ozone which is transported out with the cellulose breaks down within a certain period of time. A monitoring in the distillation column appears to be absolutely necessary, particularly with high doses of ozone (>0.5%). The acetic acid/butyl acetate mixture which is required for the distillation should possibly be degassed in the vacuum, or the excess ozone should be eliminated by chemical methods (test with the KJ-solution).

E. Solvent Exchange

After the ozone bleaching, the cellulose still contains approximately 60%, which is expelled with butyl acetate in an extraction column (2.0×10 m). Since the swelling expansion of the cellulose in acetic acid is greater than it is in butyl acetate, no problems of obstruction should arise within the column.

The quantity of the butyl acetate which, along with the pulping solution, leaves the column at the top, should amount to approximately 80% of the dry weight of the cellulose, if the wood moisture of the chopped scraps amounts to 10% because, with the subsequently following distillation, 20% water, in relation to the cellulose weight, then leaves the distillation column in the upper part, as an azeotrope with butyl acetate. Under these conditions, the butyl acetate would leave the solvent mixture completely as azeotrope, while another 2.5% water remains behind in the pulping solution, which flows back, in an undistilled manner, into the supply tank. Small quantities of extract substances, such as furfural, etc., remain in the pulping solution and do not disrupt the pulping. A separating of the formic acid from the acetic acid by means of distillation is not necessary. Changes of the composition of the pulping solution (see under "A PULPING") are to be equalized through the addition of the components which are present in the shortfall quantity.

F. Exchanges of the Butyl Acetate Against Water

The exchange of the butyl acetate against water is carried out with water vapor in a desolventizing device. The substance density of the cellulose is, by means of a helical extruder press which is connected in series in front of the desolventizing device, brought to approximately 40%. Since the evaporation enthalpy of the butyl acetate amounts to only approximately ⅕ of that of the water, the cellulose leaves the desolventizing device with 12% moisture and is subsequently pressed into plates of 1 $m^2$ in a press device.

G. Evaporation Concentration of the Spent Lye

The spent lye which leaves the cooker contains 17% dissolved lignin and hemicelluloses. Its concentration to a 50% viscous lye is carried out in a six-layer tube evaporator, with drops in pressure, during the utilization of the condensation heat, of the evaporated pulping solution.

H. Distillation

The distillation column serves only for the separation of the water which is brought in, with the chopped scraps, from the pulping solution as an azeotrope with butyl acetate. After the distillation off of the water, the pulping solution flows, in an undistilled condition, into the supply container. The capacity of the column is oriented in accordance with the moisture of the chopped scraps. If this amounts to 10%, then 200 kg. of water (together with approximately 600 kg of butyl acetate) per ton of cellulose, are to be distilled off.

Since the pulping solution contains 15% water, 1,333 $m^3$ of pulping solution +0.6 $m^3$ of butyl acetate would be necessary per ton of cellulose. With a moisture level of the chopped scraps of 20%, the quantity is doubled. It is thus to be considered whether a preliminary drying of the chopped scraps, which would also be of advantage for the capacity for storing the chopped scraps, is possible. A drying of the chopped scraps has no influence on the wood pulping in accordance with the Formacell process.

I. Spray Drying of the Viscous Lye

In all parts of the apparatus which come into contact with the hot pulping solution, steels which are resistant to corrosion from mixtures of acetic acid/formic acid/water must be used. This applied, in particular, to the cooker, the distillation column, as well as to the spray dryer.

Cellulose Qualities

In Table 4, the characteristics of the unbleached pinic celluloses which were obtained in accordance with the process in accordance with the invention (the "Formacell process") are compared with those of sulfate and acetosolve celluloses.

TABLE 3

| | Formacell | Sulfate | Acetosolve |
|---|---|---|---|
| Cap figure: | 3.6 | 30.6 | 15.6 |
| Degree of whiteness (% ISO): | 28.0 | 24.8 | 20.3 |
| GVZ (ml/g): | 1179.5 | 902.2 | 1059.0 |
| DP: | 3490.0 | 2470.0 | 3035.0 |
| R-10 (%): | 83.8 | 88.3 | 90.1 |
| Yield (%): | 46.8 | 47.4 | 49.0 |

The very low cap figure of the Formacell cellulose, which has only a slightly reduced yield relative to the conventional sulfate cellulose, which has a significantly lower requirement of the bleaching chemicals, is very striking. Because of their high R-10 value, Formacell celluloses are also suited for the production of the cellulose derivatives.

Table 4 depicts, in addition, the improvements of the Formacell process relative to the earlier Acetosolve process, which comprise, above all, a distinct improvement of the delignification and an increase of the degree of whiteness.

FIG. 1 shows a comparison of the rigidities (tearing length and tearing resistance) of Formacell and sulfate pinic cellulose in dependence on the degree of grinding.

While the tearing length of Formacell pinic cellulose is, in all the degrees of grinding, above the values of the sulfate cellulose, the tearing resistance of the Formacell cellulose is, as a whole, approximately comparable with that of the sulfate cellulose.

As can be seen from Table 5, still more favorable values are obtained with Miscanthus celluloses. Here, not only are lower cap figures and higher degrees of whiteness obtained, but also significantly higher tearing resistances than in accordance with the conventional soda processes as well. In more recent investigations, still higher tearing resistances, which come close to those of pinic sulfate celluloses, are obtained. Since the Formacell process produces, in contrast to the soda process, no spent lyes which contain sodium silicate, it is particularly well suited for the pulping of annual plants.

TABLE 5

Characteristics of Miscanthus celluloses, which were obtained in accordance with three different processes

| | Formacell | Soda | Acetosolve |
|---|---|---|---|
| Cap figure: | 3.2 | 27.2 | 13.2 |
| Degree of whiteness (% ISO): | 33.8 | 26.8 | 25.9 |
| GVZ (Ml/g): | 1012.0 | 1010.0 | 1022.5 |
| DP: | 2870.0 | 2870.0 | 2910.0 |
| R-10 (%): | 91.0 | — | 99.5 |
| Yield (%): | 48.2 | 54.6 | 48.5 |
| Tear resistance (cN): | 90.4 | 63.2 | 51.5 |
| Bursting surface ($m^2$) | 43.9 | 41.2 | 24.6 |
| Tearing strength (km): | 8.1 | 7.08 | 5.2 |

We claim:

1. A process for the extraction of cellulose from softwood lignocelluloses comprising the steps of contacting the lignocelluloses with a pulping solution consisting essentially of water, acetic acid and formic acid, and heating the pulping solution under pressure and at a temperature of between 130° C. and 190° C. during pulping, said pulping solution comprising about 50–95% by weight of acetic acid, 5 to less than 40% by weight of formic acid, and water below 50% by weight.

2. A process in accordance with claim 1, comprising reducing the moisture content of the lignocellulose by means of a pretreatment at increased temperature or by means of solvent vapors.

3. A process in accordance with claim 1, wherein the weight ratio of the lignocellulose to the pulping solution amounts to 1:1 to 1:12.

4. A process in accordance with claim 1, comprising continuously feeding crushed lignocellulose into a pressure cooker in which it is extracted, in the counter-current, from the pulping solution, and continuously discharging the extracted product from the cooker at the other side.

5. A process in accordance with claim 1, wherein the acetic acid concentration amounts to at least 50% by weight, the formic acid concentration amounts to a maximum of 40% by weight, and the water concentration amounts to a maximum of 50% by weight.

6. A process in accordance with claim 1, comprising connecting 2 to 20 pulping vessels in series one after the other, and continuously feeding crushed lignocellulose in one direction while feeding pulping solution in the opposite direction for extracting the lignocellulose.

7. A process in accordance with claim 6, comprising the step of shredding the cellulose.

8. A process in accordance with claim 6, comprising the step of continuously extracting cellulose and the step of washing the cellulose during the period of continuously extracting cellulose.

9. A process in accordance with claim 6, comprising pre-extracting the lignocellulose with a solvent for the removal of its contents.

10. A process in accordance with claim 6, comprising adding acetic anhydride to the pulping solution.

11. A process in accordance with claim 6, comprising adding a bleaching agent to the pulping solution.

12. A process in accordance with claim 6, comprising the step of impregnating the lignocellulose with formic acid, acetic acid, aetic acid anhydride, or the vapors of the same before the lignocellulose is introduced into the pulping vessel.

13. A process in accordance with claim 6, comprising the step of impregnating the lignocellulose with a solvent or with the vapors of the same, which forms, with the water, an azeotrope.

* * * * *